US005573448A

United States Patent [19]

Nakazima et al.

[11] Patent Number: 5,573,448

[45] Date of Patent: Nov. 12, 1996

[54] METHOD OF POLISHING WAFERS, A BACKING PAD USED THEREIN, AND METHOD OF MAKING THE BACKING PAD

[75] Inventors: Yukio Nakazima, Nagano; Itsuo Kuroyanagi, Chiba-ken, both of Japan

[73] Assignee: Shin-Etsu Handotai Co., Ltd., Tokyo, Japan

[21] Appl. No.: 292,248

[22] Filed: Aug. 18, 1994

[30] Foreign Application Priority Data

Aug. 18, 1993 [JP] Japan ..... 5-204098

[51] Int. Cl.[6] ..... B24B 37/04

[52] U.S. Cl. ..... 451/41; 451/287; 451/364; 51/293

[58] Field of Search ..... 451/41, 364, 397, 451/402, 412, 413, 287, 288, 289, 290, 914, 291, 398, 388; 51/293

[56] References Cited

U.S. PATENT DOCUMENTS 3,977,130 8/1976 Degner ..... 451/288

FOREIGN PATENT DOCUMENTS 4058294 5/1979 Japan ..... 451/289
2036072 2/1990 Japan ..... 451/288
3098760 4/1991 Japan ..... 451/287
1313672 5/1987 U.S.S.R. ..... 451/288

*Primary Examiner*—Robert A. Rose
*Attorney, Agent, or Firm*—Nikaido, Marmelstein, Murray & Oram LLP

[57] ABSTRACT

A template-type wafer polishing method in which a plurality of wafers are polished while they are fitted in the corresponding number of circumferentially spaced engagement holes in a template blank, with the backsides of the respective wafers held by a backing pad, wherein the backing pad has, in its one surface next to the template blank, a plurality of annular grooves each extending along a corresponding one of the engagement grooves in the template blank for relieving a stress concentrated on the peripheral edge of each wafer. The polished wafer is free from deformation, such as declination caused at the peripheral edge thereof due to stress concentration and, hence, has an extremely high degree of flatness. The backing pad and a method of making the same are also disclosed.

5 Claims, 5 Drawing Sheets

METHOD OF POLISHING WAFERS, A BACKING PAD USED THEREIN, AND METHOD OF MAKING THE BACKING PAD

BACKGROUND OF THE INVENTION

1. Field of the Invention

The present invention relates to a method of polishing semiconductor wafers and other wafers made of quartz or a ceramic material (hereinafter referred to, for simplicity, as "wafers") while holding the wafers by a template instead of using an adhesive, so as to obtain polished wafers having an extremely high degree of flatness without involving declination caused by over-polishing at the respective peripheral portions of the wafers. The present invention also concerns a novel backing pad used in the polishing method, and a method of making such backing pad.

2. Description of the Prior Art

In the so-called "template" type polishing, a plurality of wafers are polished at one time while they are fitted in a plurality of circumferentially spaced engagement holes, respectively, with their backsides held by a backing pad. The template type polishing is generally achieved by an arrangement shown in FIG. 6, in which numeral 2 denotes a turn table, 4 a polishing pad, 6 a template blank having a plurality of engagement holes 8, 10 a backing pad, 12 a polishing plate, and 14 a polishing weight. As shown in FIG. 6, a plurality of wafers W (two being shown) are polished while they are fitted in the corresponding engagement holes 8 in the template blank 6. The template blank 6 and the backing pad 10 and the backing pad 10 and the polishing plate 12 are attached together by adhesive-bonding using an adhesive, so that they jointly constitute a jig T so-called "template" for mounting thereon wafers to be polished. In FIG. 6, the adhesive layers are omitted for purposes of illustration.

In the template type polishing described above, partly because the wafers W are plunged into the polishing pad 4 by the action of the polishing weight 14, and partly because the polishing plate 12 is bent or deflected toward the wafers W by the action of the polishing weight 14, a stress is concentrated on the peripheral portion of each of the wafers W. Due to this stress concentration, the polishing rate or speed is higher at the peripheral portion of each wafer W than at the central portion of the wafter W. Thus, the peripheral portion of the wafer W is polished away in a greater amount than the central portion, so that a finished wafer W is declined at its peripheral portion.

To avoid declination of the peripheral portion of the wafer W, the following measures have been taken.

(1) A rigid polishing pad 4 or a smaller polishing weight 14 is used to reduce the amount of sinkage or plunge of the wafer W in the polishing pad 4. This measure, however, brings about unfavorable effects, such as an increased amount of scratches and a reduction of productivity due to a reduction of polishing rate.

(2) A polishing plate 12 either made of a highrigidity ceramic material or alternatively having a greater thickness is used to reduce deflection or bending of the polishing plate 12. This measure requires an expensive material and hence is short of practical use.

SUMMARY OF THE INVENTION

With the foregoing drawbacks of the prior art in view, it is an object of the present invention to provide a template type wafer polishing method which is able to polish wafers with an extremely high degree of flatness while preventing the occurrence of deformation, such as declination of the peripheral edges of the wafers, caused by a stress concentrated on the peripheral portion of the wafers.

Another object of the present invention is to provide a novel backing pad which is suitable for use in the polishing method of the present invention.

A still further object of the present invention is to provide a method of making such backing pad.

In one aspect the present invention provides a method of polishing a plurality of wafers at one time, of the type in which the wafers are polished while they are fitted in a plurality of circumferentially spaced engagement holes in a template blank, respectively, with the backsides of the wafers held by a backing pad, wherein the improvement comprises: holding the backsides of the respective wafers being polished while relieving a stress concentrated on a peripheral portion of each of the wafers.

The backsides of the respective wafers while being polished are held by a backing pad which has a surface adjacent or next to the template blank and a plurality of annular grooves formed in the above-mentioned surface and each extending along an inner peripheral edge of a corresponding one of the engagement holes of the template blank.

In another aspect the present invention provides a template for use in polishing wafers, of the type including a template blank having a plurality of circumferentially spaced engagement holes for fittingly receiving respectively therein the wafers, and a backing pad disposed on the template blank for holding the backsides of the respective wafers fitted in the corresponding engagement holes in the template blank, characterized in that the backing pad has a surface next to the template blank and a plurality of annular grooves formed in the surface and each extending along an inner peripheral edge of a corresponding one of the engagement holes in the template blank.

The annular groove formed in the surface of the backing pad is shaped such that the peripheral portions of the respective wafers are relieved from stress concentration. Preferably, each of the annular grooves has a vertical outer peripheral wall extending flush with an inner peripheral surface of a corresponding one of the engagement holes of the template blank, and a sloped inner peripheral wall forming jointly with the surface of the blank pad an angle of inclination in the range of 30 to 80 degrees, and preferably 45 to 60 degrees. The annular grooves have a width which is three to five times larger than a width of a chamfered edge of each wafer, and also have a depth which is more than 50% of the thickness of the backing pad.

Additional to the relation to the chamfering width of the wafers, the width of the annular grooves is preferably about 1% of the diameter of the wafers. When the wafers are polished, the shape of the peripheral portions of the respective wafers are variable with the width of the annular grooves.

In still another aspect the invention provides a method of making a backing pad, comprising the steps of: providing a backing pad attached by bonding to a polishing plate; placing a template blank on a top surface of the backing pad, the template blank having a plurality of circumferentially spaced engagement holes; providing a groove-forming jig which can be heated and which has a plurality of circumferentially spaced annular projections fittingly receivable in corresponding ones of the engagement holes the template blank; and forcing the annular projections of the groove-forming jig against the top surface of the backing pad through the engagement holes in the template blank while heating the groove-forming jig at a predetermined temperature, whereby a plurality of circumferentially spaced annular grooves are formed in the top surface of the backing pad.

According to the polishing method of the present invention, partly due to sinking or plunging of the wafer into the polishing pad caused by the action of the polishing weight, and partly due to distortion of the polishing plate caused by the action of the polishing weight, a stress is concentrated on the peripheral portion of each of the wafers. But the concentrated stress acts such that the peripheral portion of wafer is resiliently deformed into the corresponding annular groove in the backing pad to such an extent proportional to the magnitude of the stress. Thus, the polishing rate or speed is substantially constant without causing local raise at the peripheral portion of the wafer W. The polished wafer is, therefore, free from declination at its peripheral portion and has an extremely high degree of flatness. The backing pad used in the polishing method of the invention can be readily manufactured by using a groove-forming jig which can be heated and has an annular projection having a contour complementary in shape to the contour of an annular groove to be formed in one surface of the backing pad.

The above and other objects, features and advantages of the present invention will become manifest to those versed in the art upon making reference to the detailed description and the accompanying sheets of drawings in which a preferred structural embodiment incorporating the principle of the present invention is shown by way of illustrative example.

DETAILED DESCRIPTION OF THE INVENTION

Figure 6:
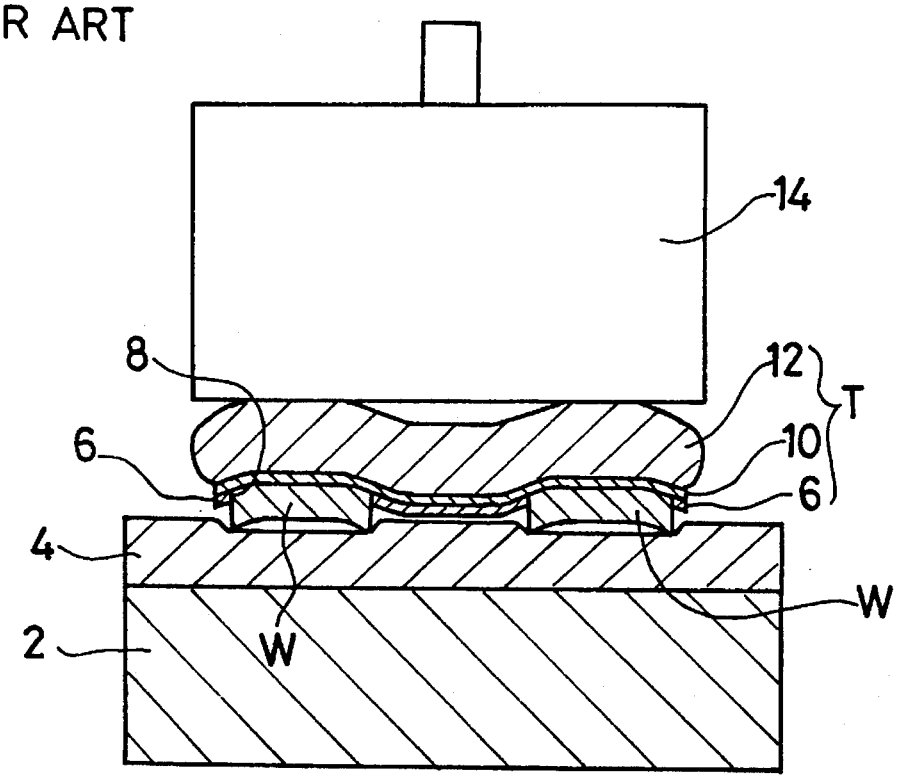
FIG. 6 PRIOR ART
FIG. 6 is a front elevational, partly cross-sectional view showing the general construction of a conventional template type polishing process.

A polishing method according to the present invention will be described in greater detail with reference to FIGS. 1 through 4. In FIGS. 1–4, these parts which are like or corresponding to those shown in FIG. 6 are designated by the corresponding reference characters.

Figure 1:
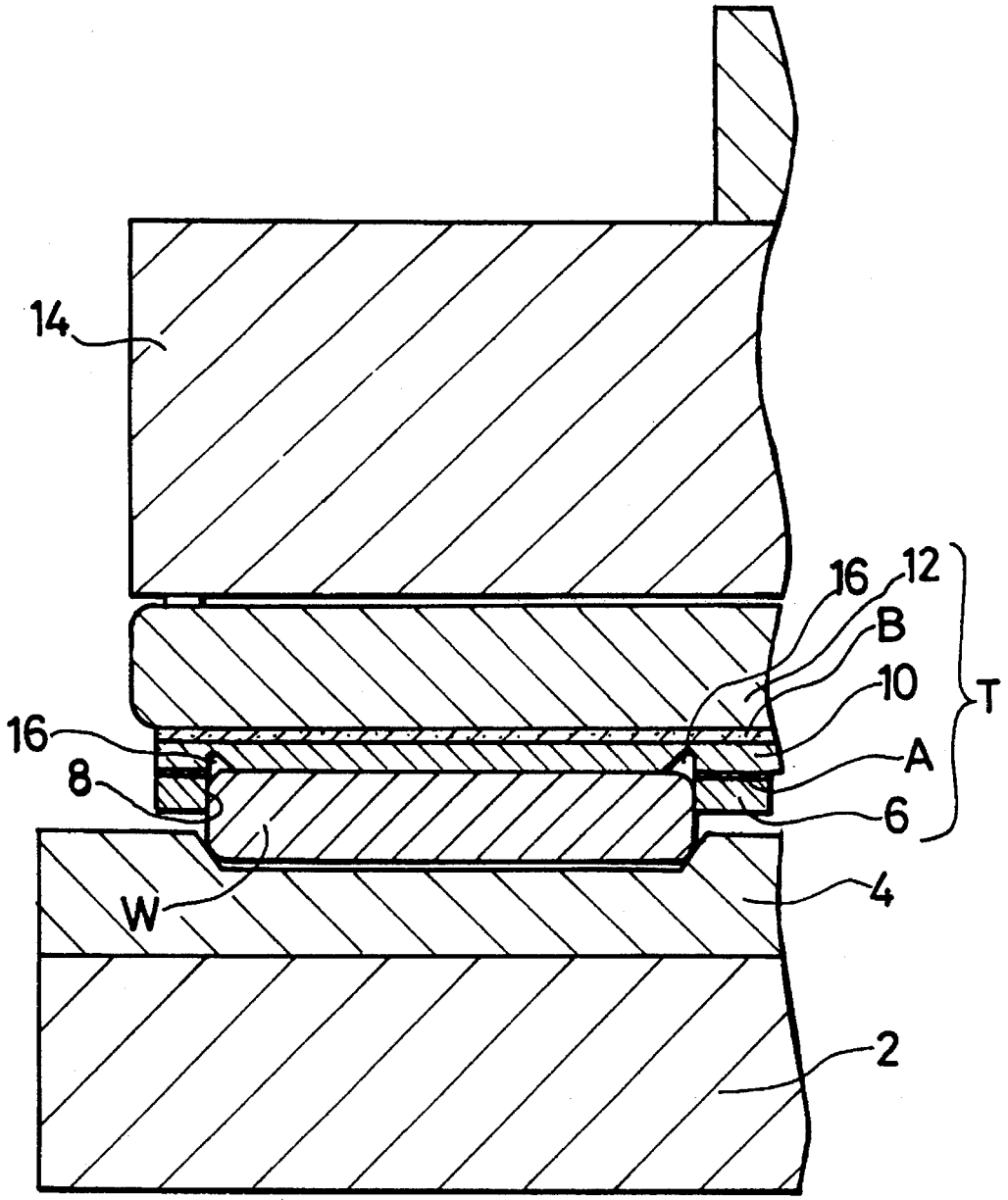
FIG. 1 is a fragmentary vertical cross-sectional view of a main portion of a polishing machine used for carrying out a method according to the present invention.
Figure 2:
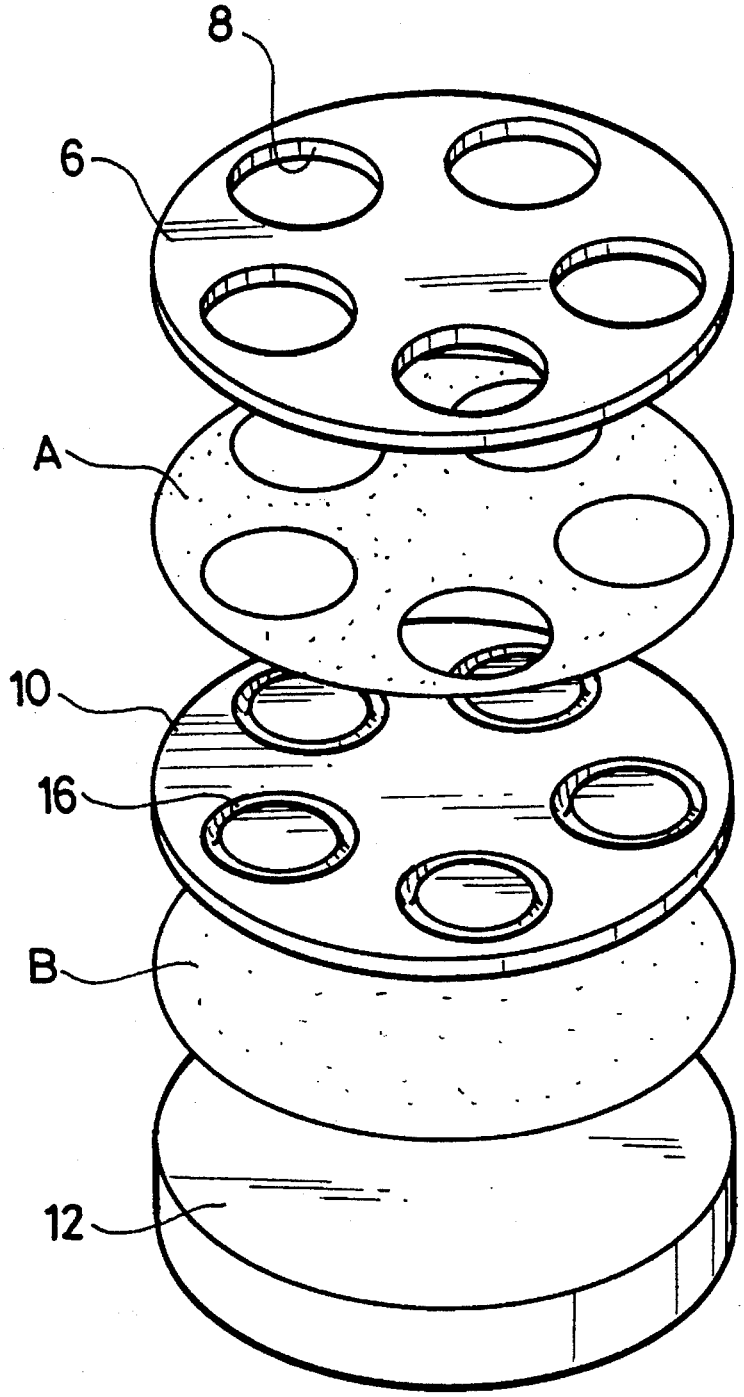
FIG. 2 is an exploded perspective view of a template constituting a main portion of the polishing machine shown in FIG. 1.

In FIGS. 1 and 2, reference numeral 2 denotes a turn table, 4 a polishing pad, 6 a template blank having a plurality of circumferentially spaced engagement holes 8 (five in the illustrated embodiment), 10 a backing pad, 12 a polishing plate, and 14 a polishing weight. Five wafers W (only one shown in FIG. 1) are polished at one time while they are fitted in the engagement holes 8 in the template blank 6. Reference character A denotes a first adhesive layer for bonding together the template blank 6 and the backing pad 10. Likewise, reference character B denotes a second adhesive layer for bonding together the backing pad 10 and the polishing plate 12. Reference character T denotes a template which forms a jig for mounting thereon the wafers W. The template T is composed of the template blank 6, backing pad 10, polishing plate 12 and first and second adhesive layers A and B.

Figure 3:
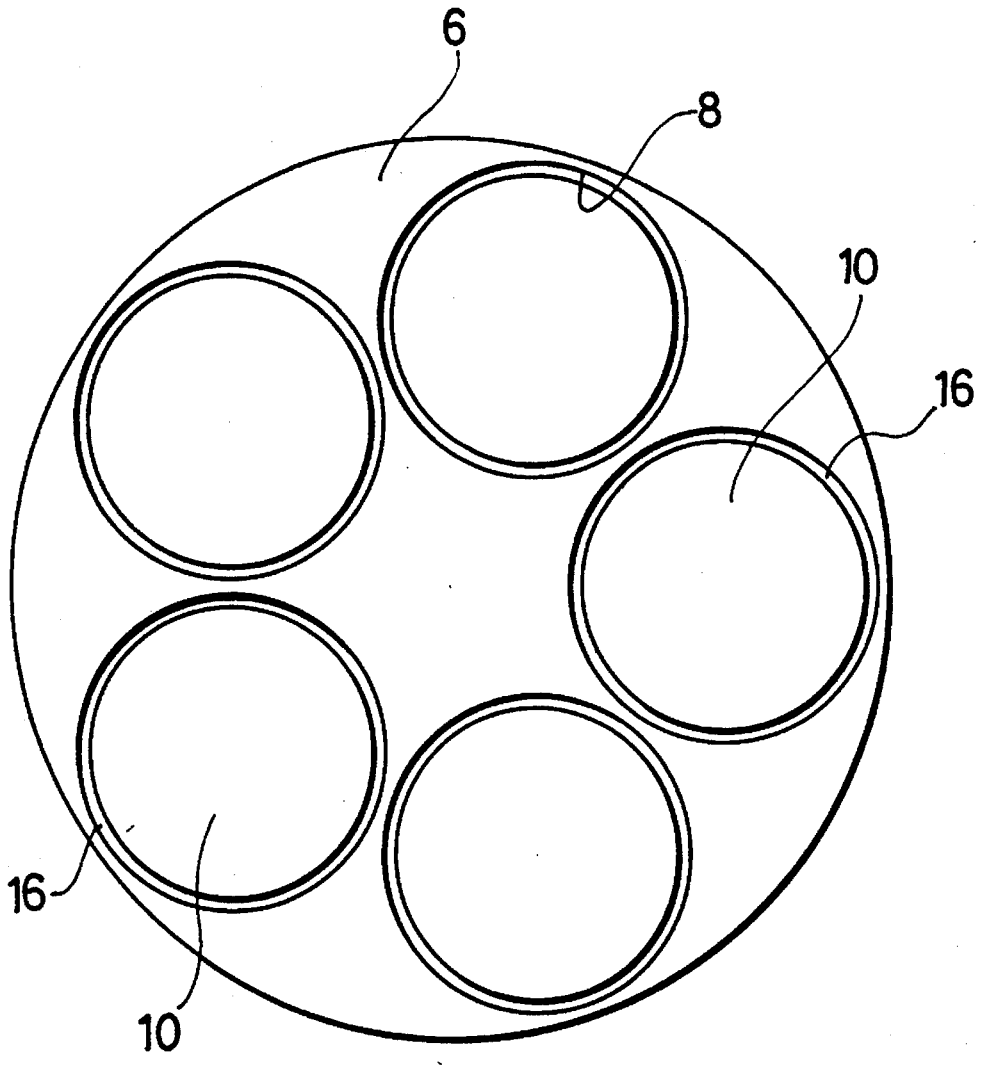
FIG. 3 is at-top plan view of an assembly composed of a template blank and a backing pad bonded together.

As shown in FIG. 3, the backing pad 10 has, formed in its one surface adjacent or next to the template blank 6, five ring-like or annular grooves 16 each extending along an inner peripheral edge of a corresponding one of the engagement holes 8 in the template blank 6. The annular grooves 16 are provided to relieve stress concentration induced at the peripheral portions of the respective wafers W. If the grooves 16 are too small in width or depth, a sufficient stress relieving effect cannot be obtained.

Figure 4:
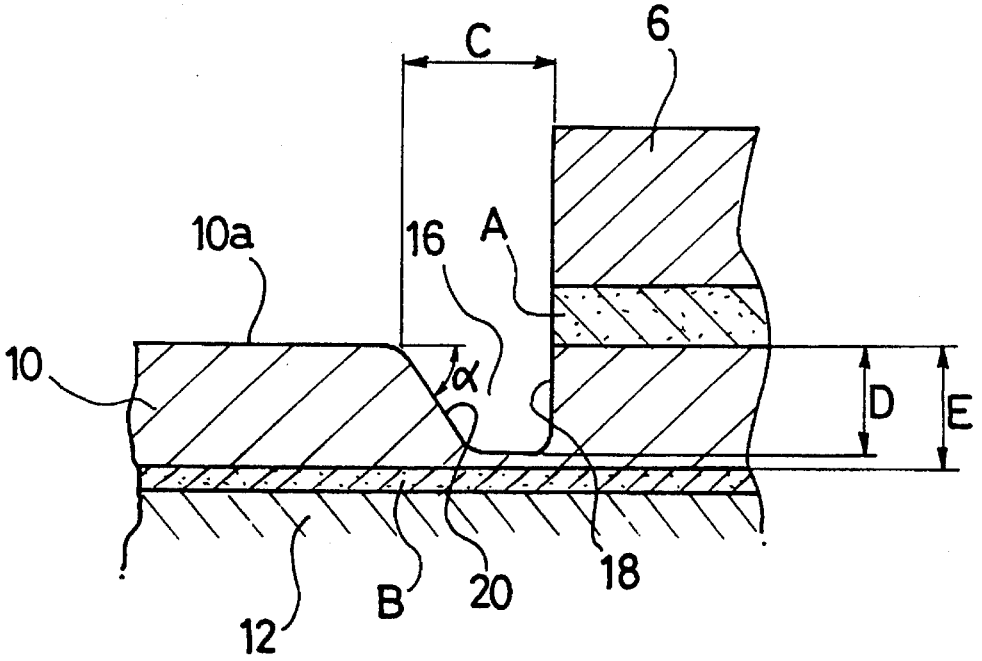
FIG. 4 is an enlarged vertical cross-sectional view of a portion of the template used for carrying out the method of the present invention.

The shape of the annular grooves 16 is shown in the enlarged cross-sectional view of a portion of the template T illustrated in FIG. 4, That is, each of the annular grooves 16 has a vertical outer peripheral wall 18 and a sloped inner peripheral wall 20. The vertical outer peripheral wall 18 extends flush with the inner peripheral surface of a corresponding one of the engagement holes 8 (FIG. 3) in the template blank 6. The sloping inner peripheral wall 20 forms, jointly with the surface 10*a* of the backing pad 10, an angle $\alpha$ of inclination in the range of 30 to 80 degrees, and preferably 45 to 60 degrees. The width C of the annular groove 16 is three to five times larger than the chamfering width of each wafer to be polished. And the depth D of the annular groove 16 is more than 50% of the thickness of the backing pad 10. The term "chamfering width" used herein is intended to refer to the width of a chamfered edge as measured in the diametric direction of the wafer.

The width C of the annular grooves 16 in the backing pad 10 is preferably about 1% of the diameter of the wafer. The shape of the peripheral portion of the wafer W being polished changes as the width C of the annular groove 16 is changed.

With the arrangement described above, due to sinking or plunging of the wafers W into the polishing pad 4 caused by the action of the polishing weight 14, and due to deflection of polishing plate 12 caused by the action of the polishing weight 14, a stress is concentrated on the peripheral portion of each wafer W. But the stress concentration thus induced tend to resiliently deforms the peripheral portion of each wafer W into the corresponding annular groove 16 in the backing pad 10 to such an extent that the amount of resilient deformation is proportional to the magnitude of the concentrated stress.

The peripheral portion of the wafer W is thus relieved or freed from stress concentration. As a result, the polishing rate or speed is substantially constant without causing local raise at the peripheral portion of the wafer W. The polished wafer W is, therefore, free from declination at its peripheral portion caused by over-polishing and, hence, has an extremely high degree of flatness.

Figure 5:
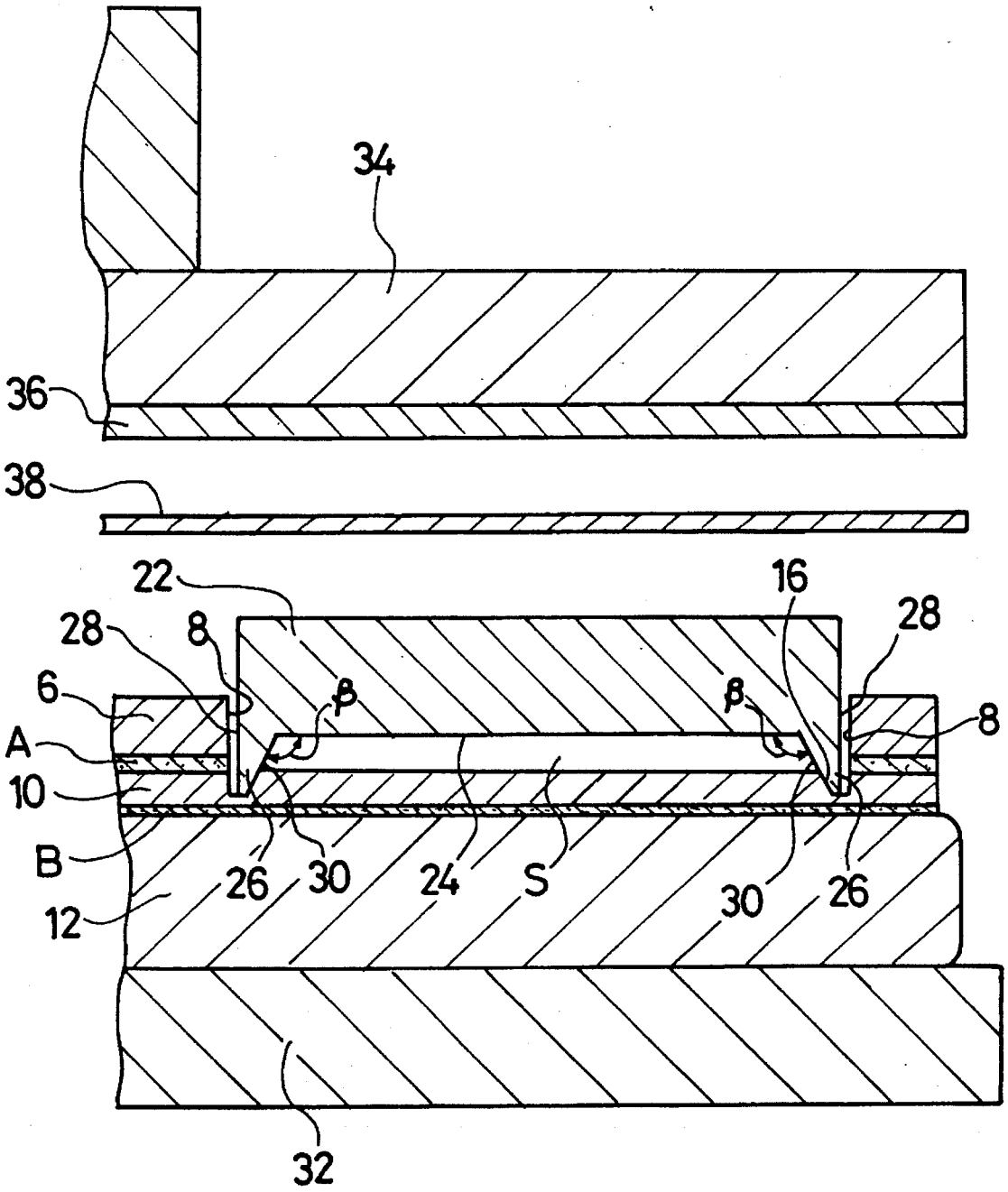
FIG. 5 is a fragmentary vertical cross-sectional view illustrative of the manner in which one annular groove of the backing pad is formed.

Referring now to FIG. 5, a method of making the backing pad 10 will be described. In FIG. 5, these parts which are identical or corresponding to those shown in FIGs. 1–4 are designated by the corresponding reference characters.

As shown in FIG. 5, the annular groove 16 of the backing pad 10 is formed by using a groove-forming jig 22. The jig 22 can be heated and is recessed in its underside so as to form a flat circular central surface 24 and an annular ridge or projection 26 extending around the central surface 24. The annular projection 26 is insertable in the engagement holes 8 in the template blank 6. The initial blank backing pad 10 which is bonded to the polishing plate 12 by the adhesive layer B has an upper surface to which the template blank 6 is bonded by the adhesive layer A so as to complete a template T.

The groove-forming jig 22 is heated at a predetermined temperature and the annular projection 26 of the heated groove-forming jig 22 is forced, through each of the engagement holes 8 in the template blank 6, against the upper surface of the initial blank backing pad 10 with the result that ring-like or annular grooves 16 are formed with heat and pressure in the upper surface of the backing pad 10. The backing pad 10 is made of a thermoformable material such as a synthetic resin which can be formed with such an annular groove 16 under heat. For example, the backing pad 10 is formed from a polyurethane sheet, and the groove-forming jig 22 is made of metal such as stainless steel. The metal, groove-forming jig 22 is heated at 120°–140° C. and pressed against one surface of the polyurethane backing pad 10 whereby an annular groove 16 is formed with heat and pressure in the surface of the final backing pad 10.

The annular projection 26 of the groove-forming jig 22, which is provided with the view of forming the annular groove 16 in the backing pad 10, is complementary in shape to the contour of the annular groove 16. Namely, the annular projection 26 has a vertical outer peripheral wall 28 and a sloped inner peripheral wall 30. The sloped inner peripheral wall 30 forms, jointly with the flat circular central surface 24, an angle $\beta$ which is supplement to the angle $\alpha$ (FIG. 3) of inclination of the sloped inner peripheral wall 20 of the annular groove 16 ($\beta=180°-\alpha$). The angle $\beta$ is in the range of 150 to 100 degrees, and preferably 135 to 120 degrees. While the groove-forming jig 22 is forced against the upper surface of the backing pad 10 to form an annular groove 16, the upper surface of the backing pad 10 and the flat circular central surface 24 of the grooveforming jig 22 are spaced by a space S.

In FIG. 5, reference numeral 32 denotes a base plate of a hot press on which is placed a template T composed of the template blank 6, backing pad 10 and polishing plate 12 that are integrated or laminated together. Numeral 34 is a press plate equipped with a heating mechanism (not shown). A ceramic plate 36 is attached to the underside of the press plate 34. Numeral 38 denotes a heat-resistant sheet which is disposed between the press plate 34 and the groove-forming jig 22.

As described above, the backing pad, used in the template type polishing method for holding the backside of each wafer, has an annular groove for relieving a stress concentrated on the peripheral portion of the wafer while the wafer is polished. As a result, the polished wafer is free from declination caused at its peripheral portion due to over-polishing and has an extremely high degree of flatness. The annular groove in the backing pad can be readily made by using a groove-forming jig that can be heated and has an annular projection having a contour complementary in shape to the contour of the annular groove.

Obviously, various minor changes and modifications of the present invention are possible in the light of the above teaching. It is therefore to be understood that within the scope of the appended claims the invention may be practiced otherwise than as specifically described.

What is claimed is:

1. A method of polishing a plurality of wafers at one time, of the type in which the wafers are polished while they are fitted in a plurality of circumferentially spaced engagement holes in a template blank, respectively, with the backsides of the wafers held by a backing pad, wherein the improvement comprises:

holding the backsides of the respective wafers being polished while relieving a stress concentrated on a peripheral portion of each of the wafers, said holding including providing a backing pad which has a surface next to said template blank and a plurality of annular grooves formed in said surface and each extending along an inner peripheral edge of a corresponding one of the engagement holes of the template blank.

2. A method according to claim 1, wherein each of said annular grooves in said backing pad has a vertical outer peripheral wall extending flush with an inner peripheral surface of a corresponding one of the engagement holes of the template blank, and a sloped inner peripheral wall forming, jointly with said surface of said blank pad, an angle of inclination in the range of 30 to 80 degrees, said annular grooves having a width which is three to five times greater than a width of a chamfered edge of each wafer, said annular grooves having a depth which is more than 50% of the thickness of said backing pad.

3. A template for use in polishing wafers, of the type including a template blank having a plurality of circumferentially spaced engagement holes for fittingly receiving respectively therein the wafers, and a backing pad disposed on said template blank for holding the backsides of the respective wafers fitted in the corresponding engagement holes in the template blank, characterized in that said backing pad has a surface next to said template blank and a plurality of annular grooves formed in said surface and each extending along an inner peripheral edge of a corresponding one of said engagement holes in said template blank.

4. A method of making a backing pad, comprising the steps of:

providing an initial blank backing pad attached by bonding to a polishing plate and having a flat top surface placing a template blank on said top surface of the initial blank backing pad, the template blank having a plurality of circumferentially spaced engagement holes;

providing a groove-forming jig which can be heated and which has a plurality of circumferentially spaced annular projections fittingly receivable in corresponding ones of the engagement holes in the template blank; and forcing the annular projections of the groove-forming jig against the flat top surface of the initial blank backing pad through the engagement holes in the template blank while heating the groove-forming jig at a predetermined temperature, whereby a plurality of circumferentially spaced annular grooves are formed in the top surface of the backing pad.

5. A method according to claim 2, wherein said angle of inclination is in the range of 45 to 60 degrees.

* * * * *